US010434392B1

(12) United States Patent
Riegel

(10) Patent No.: US 10,434,392 B1
(45) Date of Patent: Oct. 8, 2019

(54) GAMING KIT WITH GAMING PLATFORM ASSEMBLY FOR USE IN TOSSING GAME

(71) Applicant: Riegel Enterprises, LLC, Lamar, MO (US)

(72) Inventor: Timothy Edward Riegel, Lamar, MO (US)

( * ) Notice: Subject to any disclaimer, the term of this patent is extended or adjusted under 35 U.S.C. 154(b) by 0 days.

(21) Appl. No.: 15/941,094

(22) Filed: Mar. 30, 2018

(51) Int. Cl.
*A63B 63/00* (2006.01)
*A63B 67/06* (2006.01)

(52) U.S. Cl.
CPC ..... *A63B 67/06* (2013.01); *A63B 63/00* (2013.01)

(58) Field of Classification Search
CPC ..... A63B 67/06; A63B 63/08; A63B 63/00
USPC ..... 273/398–402; 473/180, 181, 185
See application file for complete search history.

(56) References Cited

U.S. PATENT DOCUMENTS

D77,020 S * 11/1928 Meilicke ..... 473/180
3,610,631 A * 10/1971 Mulherin ..... A63B 67/02 473/167
3,876,210 A * 4/1975 Brandell ..... A63B 67/02 473/185
4,236,716 A * 12/1980 Douglas, Jr. ..... A63F 7/3065 273/110
4,309,034 A * 1/1982 Matsumoto ..... A63F 9/30 273/357
4,709,929 A * 12/1987 Mills ..... A63B 63/08 273/402
5,332,230 A * 7/1994 Benedict ..... A63B 67/06 273/400
6,161,833 A * 12/2000 Gomez ..... A63B 67/06 273/400
6,464,226 B1 * 10/2002 Kephart ..... A63B 67/06 273/401
D817,409 S * 5/2018 Siepmann ..... D21/336
2004/0108658 A1 * 6/2004 Bartel ..... A63B 67/06 273/398
2007/0063447 A1 * 3/2007 Gholson ..... A63B 67/06 273/400
2015/0108719 A1 * 4/2015 Devine ..... A63B 63/08 273/402

* cited by examiner

*Primary Examiner* — Mark S Graham
(74) *Attorney, Agent, or Firm* — Wright, Lindsey & Jennings LLP; K. Brandon Middleton

(57) ABSTRACT

A tossing game using a gaming assembly with a central hub and a number of outwardly extending downwardly sloped gaming platforms connected to the central hub, each of the platforms having a hole in its playing surface, where a number of gaming pieces suitable for tossing are configured to be tossed toward the gaming assembly, the score of the tossing game being dependent upon what landing position on, in, or near the gaming assembly the various gaming pieces fall.

14 Claims, 7 Drawing Sheets

GAMING KIT WITH GAMING PLATFORM ASSEMBLY FOR USE IN TOSSING GAME

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Whether at house parties, tailgates, or just a family cookout, lawn-style games are a popular way to spend time outdoors. Lawn-style games (or games that are generally played outdoor on a flat yard or lawn) come in a variety of styles, but many lawn games include some sort of ball, bag, or other object to be tossed, thrown, or rolled. One popular lawn game, called cornhole or baggo, utilizes two angled platforms positioned at a distance apart, with the top of the platforms facing one another. The angled platforms generally have a single hole near the top center portion of the platform. The object of the game is to stand at one platform and toss bags toward the platform at the opposite end, particularly aiming to have your bags land in the hole or on the platform, with points awarded based on where the bag lands.

While cornhole is popular, the game does have its limitations. For example, there are only two targets, and these targets are placed at a fixed distance apart, with the players standing at this fixed distance for every "round" of the game. This can lead to players becoming too familiar with the distance, causing the game to lose its competitive and fun nature. Furthermore, only two players (or two teams of players) can play the game at a time, as the game is played laterally in only a single direction and the players are only tossing the game pieces (bags) in that single direction. At large events with lots of people, allowing only two people (or two small teams of people) to play the game leaves a lot of people left waiting; to solve this problem, some people purchase multiple gaming sets and having multiple games running at a time. But this can be costly and having multiple gaming sets can require a lot of storage or transportation space. What is needed is a gaming kit that brings a new and exciting edge to lawn games, one that allows multiple game plays at once and one that limits repetition so that the challenge and excitement lasts even after hours of gameplay.

BRIEF SUMMARY OF THE INVENTION

Generally speaking, the present invention is directed to a gaming kit including a gaming platform assembly, a number of tossing bags, and other gaming pieces to be used in a bag tossing game. It is an object of the present invention to provide a gaming platform assembly that includes a number of platforms positioned in a multi-directional arrangement such that multiple users may utilize the same gaming platform assembly for gameplay simultaneously. It is a further object of the present invention to provide a gaming assembly platform (and a particular method of utilizing such gaming assembly platform) that provides users with multiple modifiable gameplay scenarios.

These and other objects, features, and advantages of the present invention will become better understood from a consideration of the following detailed description of the preferred embodiments and appended claims in conjunction with the drawings as described following:

DETAILED DESCRIPTION OF THE INVENTION

Generally speaking, the present invention is directed to a gaming kit providing a number of components to be used according to a game play method such that when the components are used according to the method described herein, a novel game is created allowing multiple persons or teams of people to utilize the gaming kit for multiple uses simultaneously. More particularly, the present invention is directed to a gaming kit including a gaming platform assembly with multiple gaming platforms and a central hub, a number of gaming pieces that are configured to be tossed from one of a number of starting positions toward the gaming platform assembly, wherein the score calculated for the user is dependent upon where on or near the gaming platform assembly the various gaming pieces land. It may be seen that because of the inclusion of a number of gaming platforms on the gaming platform assembly, each platform with an angled face positioned facing a different direction, the gaming assembly can be used such that the various gaming pieces can be tossed from starting positions at different places and in different tossing directions allowing multiple gameplays simultaneously. This novel approach to gameplay may be further understood in light of the description of the particular characteristics and aspects of the various game kit components and the method of gameplay provided below.

Figure 1:
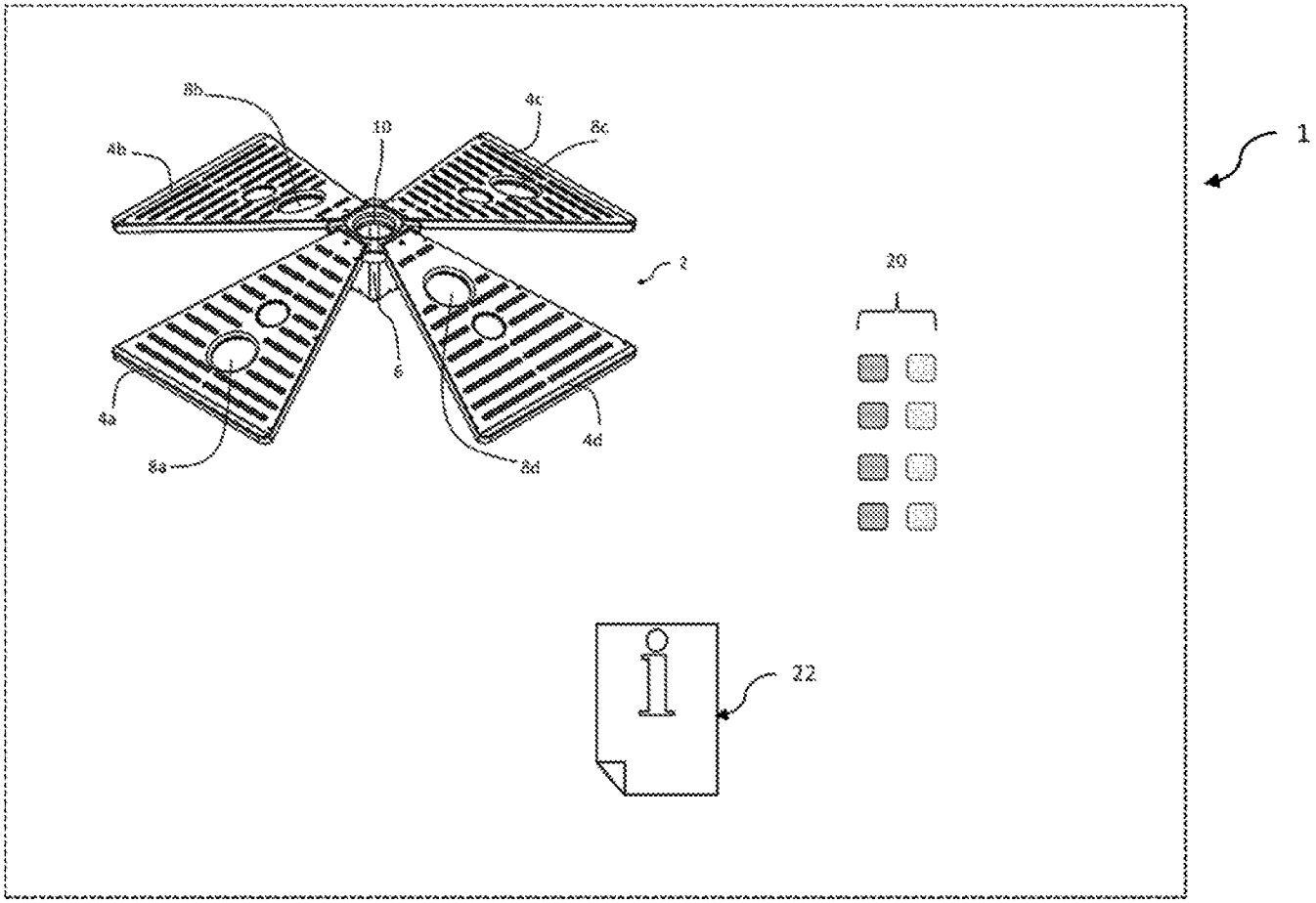
FIG. 1 shows one embodiment of the various components of the gaming kit of the present invention, including the gaming platform assembly, the gaming pieces, and a set of instructions outlining the particular method for gameplay.

Turning to the Figures, the present invention may be described in more detail. First, as mentioned above and as shown as an example in FIG. 1, the gaming kit 1 of the present invention includes a number of components: a gaming platform assembly 2, a number of gaming pieces 20, and a set of instructions 22 providing the method of gameplay using the gaming platform assembly 2 and the gaming pieces 20. Generally speaking, the gaming platform assembly 2 is used as the "target" for tossing the gaming pieces 20 from different starting positions 24 in order to score points (described more fully below). While in the preferred embodiment, the gaming kit 1 includes one gaming platform assembly 2 and eight gaming pieces 20 (four of a first color or design and four of a second color or design to denote different teams), it is contemplated that the contents of the gaming kit 1 can be modified to provide for various gaming kit packages. For example, because the gaming platform assembly 2 provides for multi-directional game play (and thus provides for multi-game use of the gaming kit simultaneously), in one alternative embodiment, the gaming kit 1 may include eight additional gaming pieces 20 (four of a third color or design and four of a fourth color or design, representing two additional teams). Alternatively, the gaming kit 1 may include only the eight original gaming pieces 20 and additional gaming pieces 20 may be sold separately to be utilized for multi-game gameplay.

Figure 3:
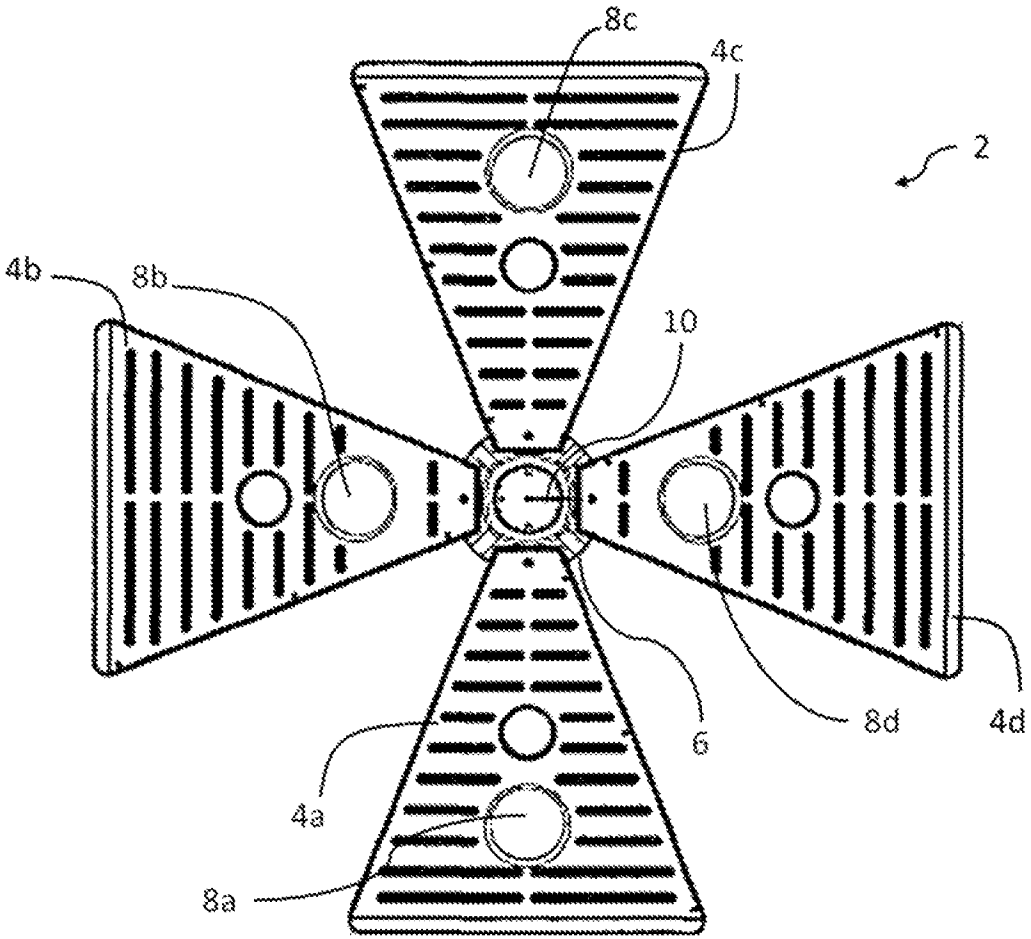
FIG. 3 is a top view of one embodiment of the gaming assembly included in the gaming kit of the present invention.
Figure 4:
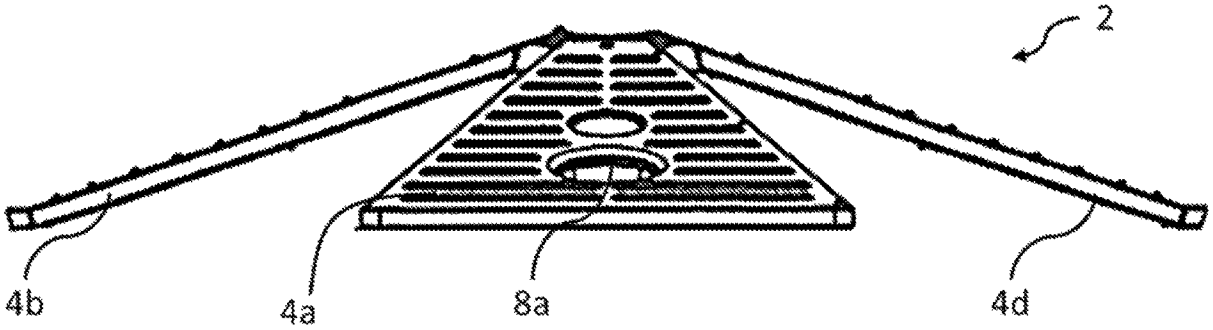
FIG. 4 is a side view of one embodiment of the gaming assembly included in the gaming kit of the present invention.
Figure 5:
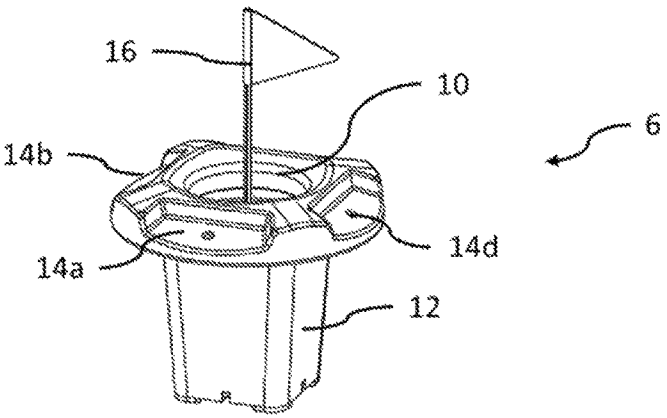
FIG. 5 is a perspective view of one embodiment of the central hub of the gaming assembly included in the gaming kit of the present invention.

Turning now to FIGS. 2-5, the structure of the preferred embodiment of the gaming platform assembly 2 may now be described. As shown, the gaming platform assembly 2 includes a number of angled platforms 4 attached to a central hub 6. The central hub 6 is preferably a container 12 with a hollow interior compartment and with a height, such that the top of the central hub 6 is elevated from the gaming surface (such as the ground, floor, or other surface). The central hub 6 is shown in detail in FIG. 5. The central hub 6 includes a number of recessed portions 14 on a top rim of the central hub 6, with these recessed portions 14 configured to receive one end of the gaming platforms 4, such that that particular end of the gaming platform 4 is lifted from the playing surface while the other end of the gaming platform 4 rests on the gaming surface, resulting in the gaming platforms 4 being angled downward from the central hub 6 (as shown, for example, in FIGS. 1 and 4). In the preferred embodiment, the central hub 6 includes a hole 10 in the top surface of the container of central hub 6, providing a place for gaming pieces 20 to land inside of gaming hub 6 (described below). In one embodiment, as shown in FIG. 5, a flag pin 16 may be placed inside the hole 10 of central hub 6 to mimic a hole at a golf course (as described below, one embodiment of the method of gameplay utilizing the gaming kit of the present invention includes golf-like scoring rules). In one embodiment, the platforms 4 of the gaming assembly may include raised lines on the surface at various points along the length of the platform 4. These raised lines are useful for holding the gaming pieces 20 on place on the platform 4 and also serve to prevent gaming pieces 20 from being slid upward along the platform 4 into the scoring holes, requiring the gaming pieces 20 to be carefully and accurately tossed for higher scoring. Similarly, the platforms may, in one embodiment, have a spine that allows for "bounce", such that precise tossing is required for scoring.

Figure 2:
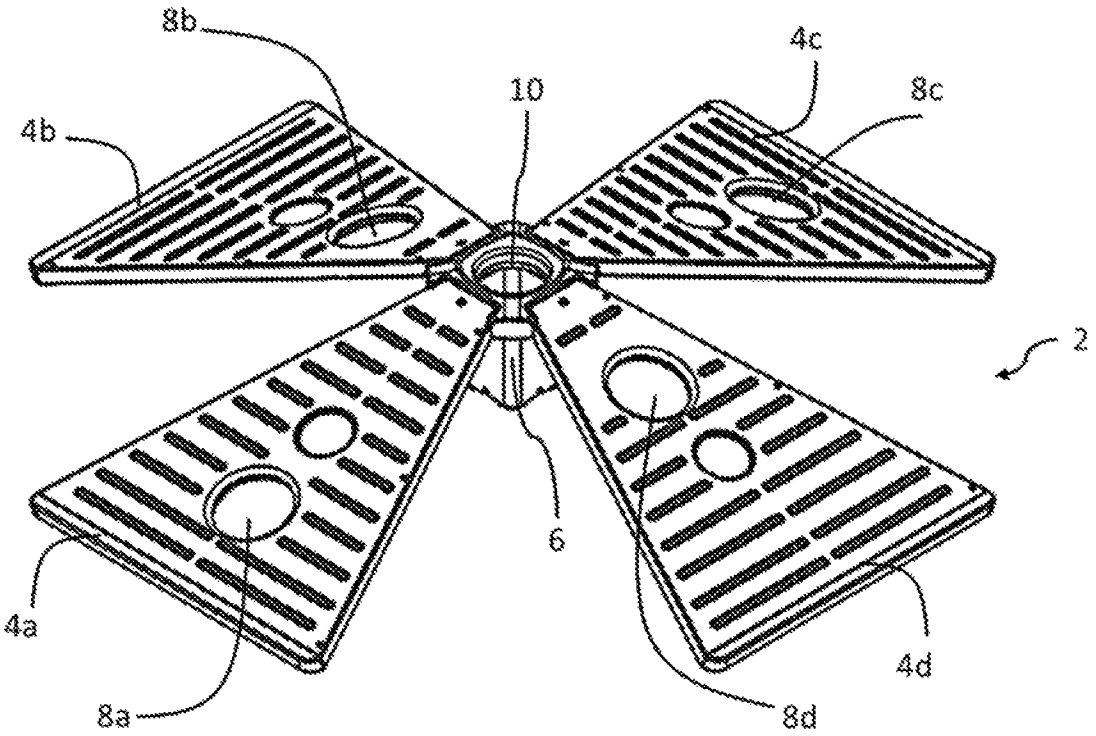
FIG. 2 is a perspective view of one embodiment of the gaming assembly included in the gaming kit of the present invention.

Specifically with regards to FIGS. 2-4, the gaming platforms 4 of the present invention may be described. For purposes of describing the specific characteristics of the platforms 4, a description may be provided with regard to a single platform 4. However, as noted above, it is intended that the gaming kit of the present invention include a number of gaming platforms 4. Even more preferably, the gaming kit of the present invention includes a gaming platform assembly 2 having four gaming platforms 4*a*, 4*b*, 4*c*, 4*d*. In the preferred embodiment, as shown in the Figures, the four gaming platforms 4*a*, 4*b*, 4*c*, 4*d* are arranged in an "x" or cross-like configuration, with two of the platforms 4*a*, 4*c* extending radially from the central hub 10 in a first lateral direction and the other two platforms 4*b*, 4*d* extending radially from the central hub 10 in a central lateral direction. As will become more apparent when read with the description of the method of gameplay below, the extension of these gaming platforms 4*a*, 4*b*, 4*c*, 4*d* in two lateral directions allows for gameplay in both directions simultaneously (even allowing, if desired, game play on all four gaming platforms 4*a*, 4*b*, 4*c*, 4*d* simultaneously if desired).

As mentioned above, the gaming platforms 4 of the gaming assembly 2 act as targets for the users during gameplay. That is (as described more fully below with regard to the method of gameplay) the gaming pieces 20 of the gaming kit 1 are tossed toward the gaming assembly 2 such that gaming pieces 20 land in various places on, In, or near the gaming assembly 2. In order to provide a place for the gaming pieces 20 to land, each of the various gaming platforms 4 include a solid surface, the solid surface providing a place to the gaming pieces 20 to fall and come to a rest. To provide additional target locations on each of the gaming platforms 4, a hole 8 is positioned on each of the gaming platforms 4, with the specific goal being for the gaming piece 20 to land in the hole 8. In one embodiment, alternating platforms 4 will have a hole 8 at different heights. For example, as shown in FIG. 3, one platform 4*a* may have a hole 8*a* toward the bottom edge (edge opposite the central hub 6), while the platform directly next to it 4*b* may have a hole 8*b* positioned closer to the top edge (edge positioned on the central hub 6), providing for different game play on each of the platforms 4. In alternative embodiments, multiple holes 8 can be positioned on one or more of the platforms 4, with each different hole 8 corresponding to a different point amount (scoring for gameplay is discussed in detail below). Thus, when the gaming assembly 2 is taken as a whole, there are essentially X locations where each of the gaming pieces 20 may fall: (a) in the hole 10 of the central hub 6, (b) on the surface of one of the angled platforms 4, (c) in the hole 8 on the surface of the angled platform 4, or (d) on the gaming surface (e.g., ground)—meaning none of the true gaming targets (either hole or platform surface) has been hit. Furthermore, because multiple gaming platforms 4 are positioned near one another, it is also possible that a gaming piece 20 will land on a gaming platform 4 not corresponding to the starting position 24 from where the user has tossed his or her gaming piece 20 (as described more fully below).

As mentioned above, the gaming kit 1 of the present invention preferably includes a number of gaming pieces 20, and more preferably includes eight gaming pieces 20. These gaming pieces 20 are intended to be tossed toward the gaming assembly 2 during gameplay. For this reason, the gaming pieces 20 are preferably made of a durable but lightweight material capable of being tossed by hand; therefore, the gaming pieces 20 are preferably beanbags, washers, or other similar tossing pieces. In the preferred embodiment, the gaming pieces 20 are broken down into two groups (with each group denoting a separate team). In order to provide a visual differentiation between the two teams, the gaming pieces 20 may be separated by color (such as black and orange), design (such as checkered and polka dot), shape (such as circle and, square) or any other differentiating characteristic that allows the game players to readily determine which of the gaming pieces 20 represent their particular team.

The particular components of the gaming kit 1 of the present invention being described above, the preferred method of game play of the gaming kit 1 of the present invention may now be described. As indicated above, the gaming kit 1 of the present invention is intended to be used by players (or teams of players) tossing their particular gaming pieces 20 toward the gaming assembly 2 from a particular starting position 24 (as shown in FIG. 7). The game is preferably played in "rounds", with the starting position 24 changing with each round. In the first round, the players stand at a first starting position 24 corresponding to a first one of the angled platforms 4*a*. The players alternate taking turns throwing their gaming pieces 20 toward the gaming assembly 2, with the goal being to land their gaming pieces 20 on the surface of the corresponding gaming platform 4*a*, in the hole 8*a* of the corresponding gaming platform 4*a*, or in the hole 10 of the central hub 6. Scoring for the particular round is dependent on where a player's gaming pieces 20 land in relation to the gaming assembly 2 and in relation to where the gaming pieces 20 of their opponent has landed. Scoring possibilities are discussed below with reference to FIG. 6. Once all gaming pieces 20 have been tossed for the round and the scores have been calculated, play moves to a different gaming platform 4 and the next round begins. The goal of this round remains the same: to land your team's gaming pieces in the highest scoring target locations. In the preferred embodiment, with each round the players toss their gaming pieces 20 from a new position.

Figure 7:
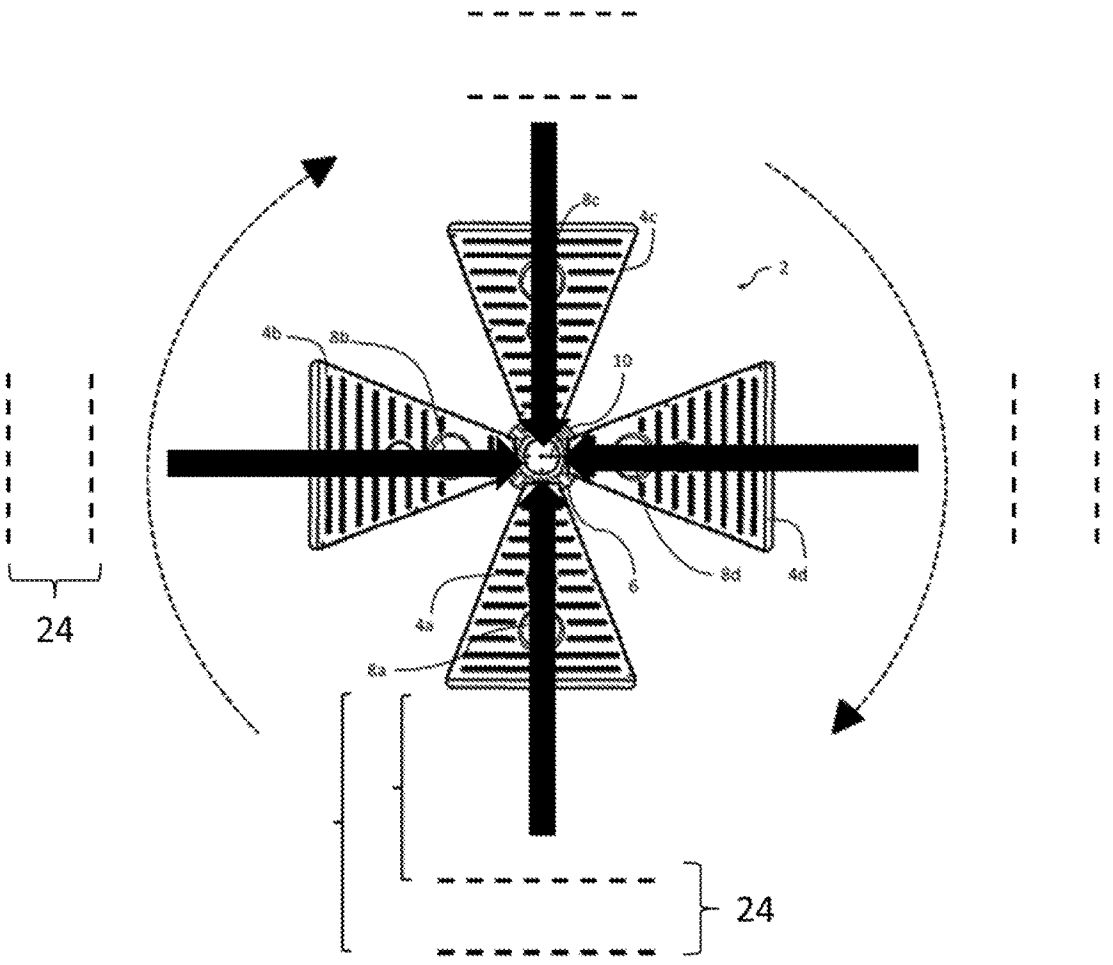
FIG. 7 is a top view of one embodiment of the gaming assembly included in the gaming kit of the present invention, showing an example of rotational direction of gameplay between the various gaming platforms of the gaming assembly and showing an example of user position during various rounds of gameplay.
Figure 8:
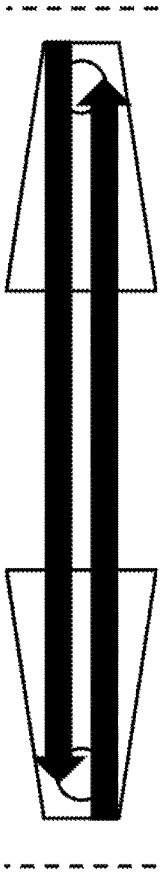
FIG. 8 prior art
FIG. 8 is a top view of one example of a prior art game, showing the cross-directional game play required by such prior art game.

As indicated previously, use of the gaming assembly 2 for multiple simultaneous games is contemplated. This simultaneous use is achieved by different games (or by different players as part of the same team in the same game) playing on different gaming platforms 4 simultaneously. Take as an example, a situation where there are two separate games being played at the same time. The players of the first game start first on the first platform 4*a*, toss all of their gaming pieces 20, and calculate their score for the first round before moving onto the second platform 4*b*. A second set of players then begins a second game, starting on the first platform 4*a* while the previous game is playing on the second platform 4*b*. In traditional games, this type of play would not be possible because the tossed gaming pieces 20 would be traveling in opposing directions, which could lead to gaming pieces 20 of one game interfering with gaming pieces 20 of the other game (an example of the cross-directional play is shown in FIG. 8). However, because there is no cross-directional play, the gaming assembly 2 of the present invention can be used for multiple gameplays at the same time, as shown in FIG. 7, with game play being possible on each gaming platform 4 simultaneously. Thus, while in traditional toss style games only one game can be played on a particular gaming set, the gaming kit of the present invention allows multiple games simultaneously up to the number of gaming platforms 4 included with the gaming assembly 2 (which, as mentioned above, is preferably four gaming platforms 4).

Figure 6:
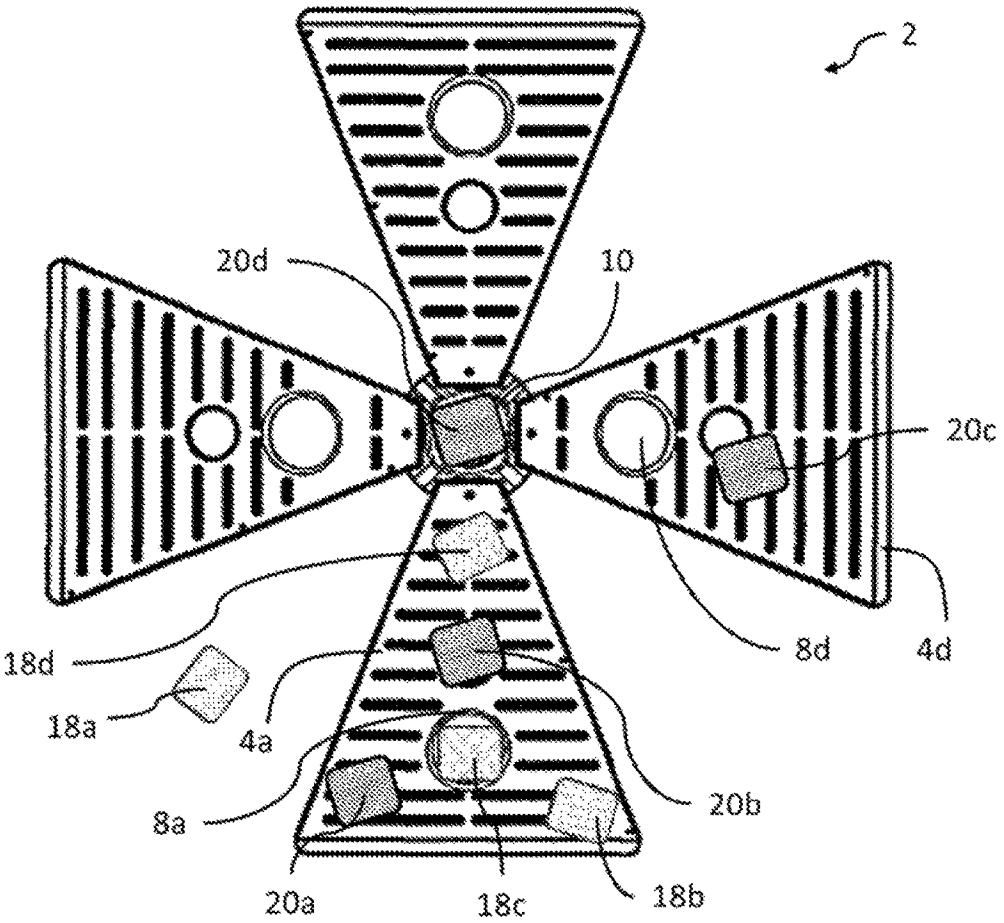
FIG. 6 is a top view of one embodiment of the gaming assembly included in the gaming kit of the present invention, showing an example of gaming pieces positioned in various scoring and non-scoring positions at the gaming assembly.

While multiple simultaneous gameplay is possible, FIG. 6 shows an example of scoring for a single round where only one gaming platform 4*a* is being played on. As mentioned previously, there are five potential places where a single gaming piece may fall when tossed: (a) in the hole 10 of the central hub 6, (b) in the hole 8*a* of the platform 4 in play, (c) on the surface of the platform 4*a* in play, (d) on the gaming surface (such as ground or floor), or (e) on the surface of another platform 4*b*, 4*c*, 4*d* not in play (in play meaning the platform 4 corresponding to the starting position 24 from where the gaming piece is being tossed for the particular round of scoring). Different point values may be assigned to each of these landing positions. It is also contemplated that different point values may be assigned to the hole 8 on the platform 4, depending on whether the hole 8 is a lower hole or a higher hole (e.g. 8*a* versus 8*b*). Alternatively, a single point value may be awarded for the hole 8 for each of the platforms 4. Furthermore, as described above, it is contemplated that one embodiment of the gaming assembly 2 includes multiple holes 8 (i.e. a lower hole and an upper hole) on each of the platforms (rather than a single hole as shown in the figures). Again, different scoring values may be awarded to each hole or a single hole value may be awarded.

While the object of the game remains the same (that is to land the gaming pieces 20 on the better target areas), at least two scoring methods are contemplated. In the first scoring embodiment, the scoring method utilizes golf-like scoring: meaning that the lower score is the winner. Under this scoring method, the preferred scores for the different landing positions are as follows: (a) "ace" or "4 under par" or (−4) for a gaming piece 20 landing in the hole 10 of the central hub 6, (b) "eagle" or "2 under par" or (−2) for a gaming piece 20 landing in the higher hole 8 of a platform 4, (c) "birdie" or "1 under par" or (−1) for a gaming piece landing in a lower hole 8 of a platform 4, (d) "par" or (0) for a gaming piece 20 landing on the surface of the platform 4 in play, (e) "bogey" or "1 over par" or (+1) for a gaming piece 20 landing on the gaming surface (such as ground or floor), and (f) "double bogey" or "2 over par" or (+2) for a gaming piece 20 landing on an adjacent platform 4 that is not in play. Alternatively, a traditional style scoring with higher-point wins rules may be implemented. In this case the following scoring points may be awarded in a particular embodiment: (a) 6 points for a gaming piece 20 landing in the hole 10 of the central hub 6, (b) 4 points for a gaming piece 20 landing in a high hole 8 of a platform 4, (c) 3 points for a gaming piece 20 landing in a low hole 8 of a platform 4, (d) 1 point for a gaming piece 20 landing on the surface of the platform 4 in play, and (e) zero points for a gaming piece 20 that lands on the gaming surface or that lands on an adjacent platform 4 not in play. Of course, different scoring methods could be utilized to modify the particular gameplay, but in the preferred embodiment, the hole 10 in central hub 6 is the highest value target and the gaming surface or out-of-play platform is the lowest value target.

Turning more specifically to the location of gaming pieces 20 positioned on or near the gaming assembly 2 as shown in an exemplary round depicted in FIG. 6, a particular example scoring may be described. As shown in FIG. 6, there are two players (or two teams of players), one team denoted by light gaming pieces 18 and the other team denoted by the darker gaming pieces 20. Each of the teams four gaming pieces have been tossed toward the gaming assembly 2. As shown, the light gaming pieces have landed in four locations: on the gaming surface (18*a*), on the surface of the platform 4*a* in play (18*b*), in the hole 8*a* of the gaming platform 4*a* in play (18*c*), and another on the surface of the platform 4*a* in play (18*d*). In the golf-style scoring, the gaming pieces would have a score of: (+1), (0), (−1), (0), for a final score for the round of (0). The darker gaming pieces, on the other hand, have landed in the following positions: on the gaming platform 4*a* in play (20*a*), on the gaming platform 4*a* in play (20*b*), on an adjacent gaming platform 4*d* not in play (20*c*), and in the hole 10 of the central hub 6 (20*d*). Thus, the darker gaming pieces have point values in the golf-style scoring of: (0), (0), (+2), and (−4), for a final score for the round of (−2). Once these scores are calculated, the players rotate to the next gaming platform 4*b* and toss their gaming pieces until all have been thrown and scores for the second round have been calculated. When all rounds have been played (for example, 8 total rounds such that each platform 4 is used twice), the final scores are calculated and the lowest score wins. The same process is used for scoring under the more traditional high-score wins rules. (Light=0, 1, 3, 1 for total of 5 and dark=1, 1, 0, 6 for total of 8). In one embodiment, the traditional-style scoring may also use a "knock-out" style scoring process, meaning that only one player scores per round with the scoring of the opposing player cancelling out a portion of the scoring player's score total (for the example above, the five points awarded to the light team would cancel out five of the dark team's point, therefore leaving the final scoring for the round as three points to the dark team). In traditional-style scoring, the first player to reach a particular score limit is the winner.

Unless otherwise stated, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein. It will be apparent to those skilled in the art that many more modifications are possible without departing from the inventive concepts herein.

All terms used herein should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. When a Markush group or other grouping is used herein, all individual members of the group and all combinations and subcombinations possible of the group are intended to be individually included. All references cited herein are hereby incorporated by reference to the extent that there is no inconsistency with the disclosure of this specification. When a range is stated herein, the range is intended to include all sub-ranges within the range, as well as all individual points within the range. When "about," "approximately," or like terms are used herein, they are intended to include amounts, measurements, or the like that do not depart significantly from the expressly stated amount, measurement, or the like, such that the stated purpose of the apparatus or process is not lost.

The present invention has been described with reference to certain preferred and alternative embodiments that are intended to be exemplary only and not limiting to the full scope of the present invention, as set forth in the appended claims.

I claim:

1. A gaming assembly comprising:

a. a central hub, wherein the central hub comprises an upper end, a lower end, and at least one side surface connecting the upper end and lower end to create a hollow compartment, further wherein the central hub comprises a hole in its upper end such that the hollow compartment is capable of receiving one or more gaming pieces;

b. at least three platforms extending outwardly from the central hub at spaced apart intervals, each of the platforms comprising a first end, a second end, and a planar top surface connecting the first end and second end, whereby the platforms extend outwardly from the central hub in a number of downwardly angled directions;

wherein the planar top surface of each platform comprises a solid gaming area and a hole, wherein the solid gaming area is substantially larger than an area defined by the hole.

2. The gaming assembly of claim 1, wherein the hole of the platform is capable of receiving one or more tossable game pieces, wherein the area defined by the hole is larger than the one or more tossable game pieces such that the one or more tossable game pieces is capable of fitting entirely through the hole.

3. The gaming assembly of claim 1, wherein the platforms are removably attachable to the central hub.

4. The gaming assembly of claim 1, comprising a first platform and a second platform, wherein the first platform extends outwardly from a first side of the central hub and wherein the second platform extends outwardly from a second side of the central hub.

5. The gaming assembly of claim 4, wherein the first side is opposite the second side.

6. The gaming assembly of claim 4, wherein the first side is adjacent to the second side.

7. The gaming assembly of claim 4, further comprising a third platform extending outwardly from a third side of the central hub.

8. The gaming assembly of claim 7, wherein the first side is opposite the second side, further wherein the third side is adjacent to both the first side and the second side.

9. The gaming assembly of claim 8, further comprising a fourth platform extending outwardly from a fourth side of the central hub.

10. The gaming assembly of claim 9, wherein the first side is opposite the second side, further wherein the third side is opposite the fourth side, and further wherein each of the third side and fourth side is adjacent to both the first side and the second side.

11. A tossing game to be played by a number of players on a gaming surface, the game comprising:

a. a gaming assembly configured to be placed upon the gaming surface, the gaming assembly comprising:
   i. a central hub having a hole; and
   ii. at least three platforms extending outwardly from the central hub at downwardly sloped angles, each of the platforms comprising a substantially planar playing surface and a hole in the playing surface, wherein the platforms are positioned around the central hub at spaced apart intervals; and b. a plurality of gaming pieces, wherein a first subset of the plurality of gaming pieces corresponds to a first subset of the number of players and a second subset of the plurality of gaming pieces corresponds to a second subset of the number of players, wherein the plurality of gaming pieces are suitable for being tossed toward the gaming assembly such that each of the plurality of gaming pieces, after being tossed, is configured to land at one of a number of target positions on the gaming assembly, wherein the number of target positions comprises the substantially planar playing surface of a first of the platforms, whereby a score for each subset of the number of players is determined dependent upon the particular target position upon which each of the subset of the plurality of gaming pieces corresponding to the particular subset of players lands.

12. The tossing game of claim 11, wherein the number of target positions further comprises the hole in the central hub, the playing surface of the remaining platforms, the hole in the playing surface of the first of the platforms, and the gaming surface.

13. The tossing game of claim 11, further wherein the plurality of gaming pieces comprises a third subset corresponding to a third subset of the number of players and a fourth subset corresponding to a fourth subset of the number of players, wherein the gaming assembly is configured such that a first of the platforms is capable of being used by the first and second subset of players at the same time that a second of the platforms is capable of being used by the third and fourth subset of players, wherein the use by the different subsets of players is in different, non-overlapping tossing directions.

14. A gaming kit comprising:

a. a central hub;

b. a platform assembly comprising four platforms extending from the central hub at a downward angle, wherein each of the four platforms comprises an upward surface, further wherein the four platforms extend from the central hub at spaced apart intervals, thereby defining a gaming area having a portion comprised of the upward surfaces of the platforms and a portion comprised of negative space between each of the four platforms, and further wherein each of the four platforms comprises a hole in the upward surface; and c. a plurality of gaming pieces, wherein the plurality of gaming pieces are suitable for being tossed toward a particular one of the four platforms such that each of the plurality of gaming pieces, after being tossed, is configured to land at one of a number of target positions with respect to the particular platform, wherein the number of target positions comprises (i) the upward surface of the particular platform, (ii) the central hub, (iii) the hole in the upward surface of the particular platform, and (iv) the negative space adjacent to the particular platform.

* * * * *